United States Patent [19]

Powers et al.

[11] Patent Number: 4,789,971

[45] Date of Patent: Dec. 6, 1988

[54] BROADBAND, ACOUSTICALLY TRANSPARENT, NONRESONANT PVDF HYDROPHONE

[75] Inventors: James M. Powers, Norwich; Mark B. Moffett, Waterford, both of Conn.; John C. McGrath, Surbiton, England

[73] Assignee: The United States of America as represented by the Secretary of the Navy, Washington, D.C.

[21] Appl. No.: 855,643

[22] Filed: Apr. 7, 1986

[51] Int. Cl.[4] ..... H04R 17/00

[52] U.S. Cl. ..... 367/152; 367/157; 310/337; 310/800

[58] Field of Search ..... 310/800, 337; 367/152, 367/155, 156, 163, 174, 157, 160

[56] References Cited

U.S. PATENT DOCUMENTS

| | | | |
|---|---|---|---|
| 4,295,212 | 10/1981 | Swenson | 367/154 |
| 4,364,117 | 12/1982 | Snow | 367/152 |
| 4,433,400 | 2/1984 | De Reggi et al. | 310/800 |
| 4,523,122 | 6/1985 | Tone et al. | 367/152 |
| 4,535,205 | 8/1985 | Ravinet et al. | 367/163 |
| 4,555,953 | 12/1985 | Dario et al. | 310/338 |
| 4,638,468 | 1/1987 | Francis | 310/800 |
| 4,656,870 | 4/1987 | Ruthrof et al. | 310/319 |

*Primary Examiner*—Charles T. Jordan
*Assistant Examiner*—John W. Eldred
*Attorney, Agent, or Firm*—Michael J. McGowan; Arthur A. McGill; Prithvi C. Lall

[57] ABSTRACT

An acoustically transparent voided, polyvinylidene fluoride (PVDF) hydrophone made of material whose impedance matches the characteristic acoustic impedance ($\rho c$) of sea water, having drastically reduced diffraction and resonance effects. The frequency response is thus flat at frequencies less than one-half elastic wavelength in the PVDF material. An array of such hydrophones in front of a projector saves space without affecting projector performance.

12 Claims, 3 Drawing Sheets

BROADBAND, ACOUSTICALLY TRANSPARENT, NONRESONANT PVDF HYDROPHONE

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The present invention relates to acoustic sensors and more particularly to broadband, acoustically transparent, nonresonant, passive PVDF hydrophones.

(2) Description of the Prior Art

Conventional hydrophones are made of piezoelectric materials that are acoustically hard (having a large characteristic acoustic impedance, i.e., density sound speed product, $\rho c$) compared to the surrounding water medium with impedances 10 to 20 times that of water. Because of this acoustic impedance mismatch, an incoming sound wave is partiall reflected from and diffracted around the hydrophone. The pressure sensed by the hydrophone is thus not the free field pressure but the sum of the free field and the diffracted pressures. Because the latter depend on the frequency, they give rise to a frequency-dependent hydrophone sensitivity response. Furthermore, the mechanical vibrations induced in the piezoelectric element by the sound pressure field undergo strong internal reflections at the element boundaries because of the impedance mismatch between the element and the acoustic medium. This means that the element is resonant at certain frequencies, with a response that can be 10 dB or so larger than at other frequencies. Of course one usually operates the hydrophone at frequencies well below these resonances. It is not always practical however to eliminate small components (such as harmonics of the frequencies of interest) near resonance that become unduly amplified by the hydrophone response.

Piezoelectric polyvinylidene fluoride (PVDF) material approaches water's acoustic impedance, having a characteristic impedance of about 2.7 times that of water. This material was, however, available only in thin, nonvoided sheets having very low sensitivities. In order to provide adequate hydrophone sensitivity such material would have to be combined with pressure-release components such as compliant tubes or cylinders which would then reintroduce reflection problems. U.S. Pat. No. 4,433,400 describes an acoustically transparent hydrophone which utilizes such nonvoided, thin-film, PVDF sheets stretched over a metal hoop. The "transparency" in this case is due only to the fact that the PVDF sheets are very thin ($\sim 50\ \mu m$). This type of hydrophone has very low sensitivity ($\sim -234$ dB//1 V/$\mu$Pa) and exhibits resonances at frequencies below 1 MHz due to the presence of the hoop.

Thorn EMI Central Research Laboratories has developed a process for producing voided PVDF. Voided PVDF is produced by tensile drawing PVDF material in a manner which induces microcavities throughout the film. Tensile drawing of the material is carried out under conditions of high stress. The high stress is achieved by drawing the material at relatively low temperatures and high speeds in order to produce the microcavities, e.g., 80° C. and 55 mm/minute. This material has been produced in thicknesses up to 1 mm and does not require the use of pressure-release components because it can be operated in a volume-expander mode. As a result of the voiding process the characteristic impedance can actually be made as low as 85% that of water.

SUMMARY OF THE INVENTION

Accordingly, it is a general purpose and object of the present invention to provide an acoustically transparent hydrophone. It is a further object that such hydrophone be broadband. Another object is that such hydrophone be nonresonant. A still further object is that the hydrophone sensing element be of a voided PVDF material. Still another object is that such hydrophone provide a nearly flat frequency response at frequencies below 1 MHz.

These objects are accomplished with the present invention by providing an acoustically transparent, voided, polyvinylidene fluoride (PVDF) hydrophone element that matches the characteristic acoustic impedance of sea water, thereby reducing diffraction and resonance effects. The frequency response is thus nearly flat. Because they are acoustically transparent, an array of such hydrophones may be placed in front of a projector array, thereby saving space without affecting projector performance.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

The reflection coefficient (the ratio of reflected and incident pressures) for a plane interface between two media at normal incidence is well-known to be $$\frac{P_{refl}}{P_{inc}} = \frac{\rho_2 c_2 - \rho_1 c_1}{\rho_2 c_2 + \rho_1 c_1} \tag{1}$$

where $P_{refl}$ and $P_{inc}$ are the reflected and incident pressure amplitudes respectively, $\rho_1$ is the density of the incident medium, $\rho_2$ is the density of the reflecting material, $c_1$ is the sound speed in the incident medium, and $c_2$ is the sound speed in the reflecting material. It can be seen from Eq. (1) that if $$\rho_2 c_2 = \rho_1 c_1 \tag{2}$$

i.e., if the characteristic acoustic impedance (the $\rho c$ product) of the reflecting material is equal to that of the incident medium, then the reflected pressure, $P_{refl} = 0$. Thus, an acoustically transparent device can be realized if it comprises plane layers of materials whose impedances are all equal to that of the medium.

Figure 1:
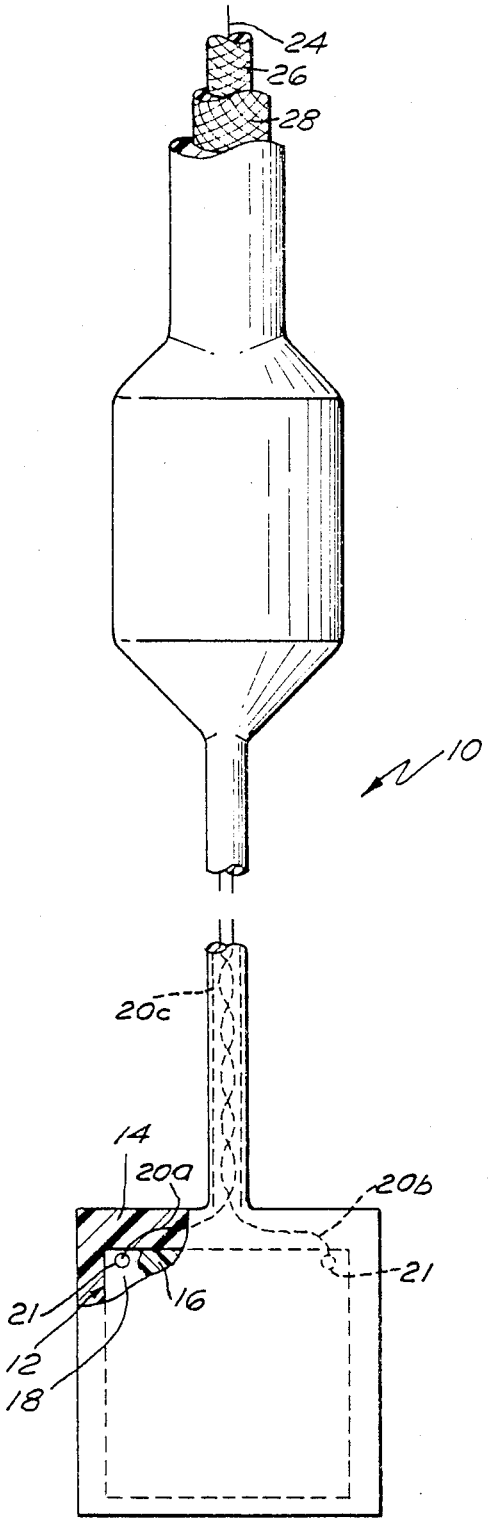
FIG. 1 shows a front view of an acoustically transparent hydrophone according to the present invention.

FIG. 1 shows a broadband, acoustically transparent hydrophone 10 comprising a $\rho c$ sensing element assembly 12 embedded in a $\rho c$ potting elastomer 14. Because the acoustically active parts of the hydrophone are constructed entirely of $\rho c$ materials, reflections and diffraction are eliminated and a flat frequency response hydrophone is produced. Element assembly 12 further comprises a slab of voided PVDF material 16 sandwiched between a pair of parallel copper electrodes 18. Element assembly 12 is electrically connected to a twin lead cable 20. Cable 20 is a twisted pair of leads **20*a* and 20*b* and may have an outer shield 20*c* if desired. Tin/-lead solder connections 21 attach leads 20*a* and 20*b* to electrodes 18. It is noted that while element assembly 12** is shown as rectangular, any other planar shape may be used without deviating from this invention.

Figure 2:
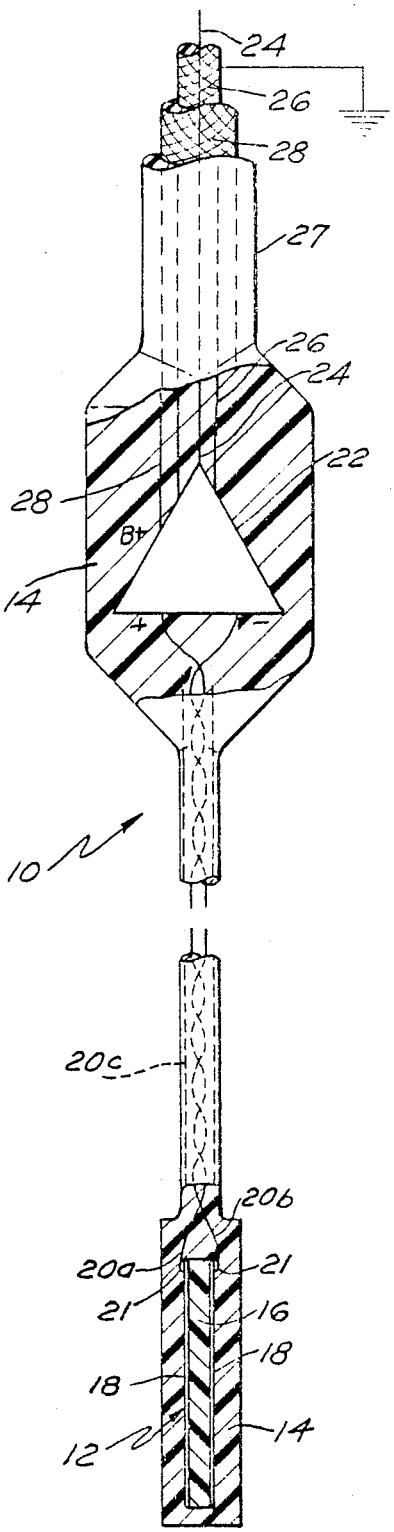
FIG. 2 shows a side view of the hydrophone of FIG. 1.

FIG. 2 shows a side view of hydrophone 10. Voided PVDF slab 16 is selected to have a characteristic acoustic impedance equal to that of water. To insure that this is the case, the compressional wave speed in the slab 16 material is measured (e.g., by an immersion technique in which the phase shift between an ultrasonic projector and receiver is measured with and without the voided PVDF material inserted in the acoustic path) as well as the density. Typical values are 1000 m/s compressional wave speed and 1500 kgm/m$^3$ density. Electrodes 18 are deposited on the faces of PVDF slab 16 by an electroless process. This plating is made thicker in the lead 20 attachment areas by conventional electroplating. Electrically conducting leads, **20*a* and 20*b*, are then attached to electrodes 18 with conventional tin/lead solder 21. Leads 20 are fed to a preamplifier 22 which in turn feeds a center conductor 24 and a shield 26 of a triaxial cable 27. Shield 26 is attached to a suitable ground. Direct current power (B+) for preamplifier 22 is supplied on outer conductor 28 and shield 26 of cable 27. Hydrophone assembly 10 is potted in a window material under vacuum (to eliminate air bubbles) using an elastomer 14, such as URALITE 3138 polyurethane or the like, whose density, $\rho$, and sound speed, c, closely match those of water. The thickness of elastomer 14** is not critical but should be selected to provide waterproofing.

Figure 3:
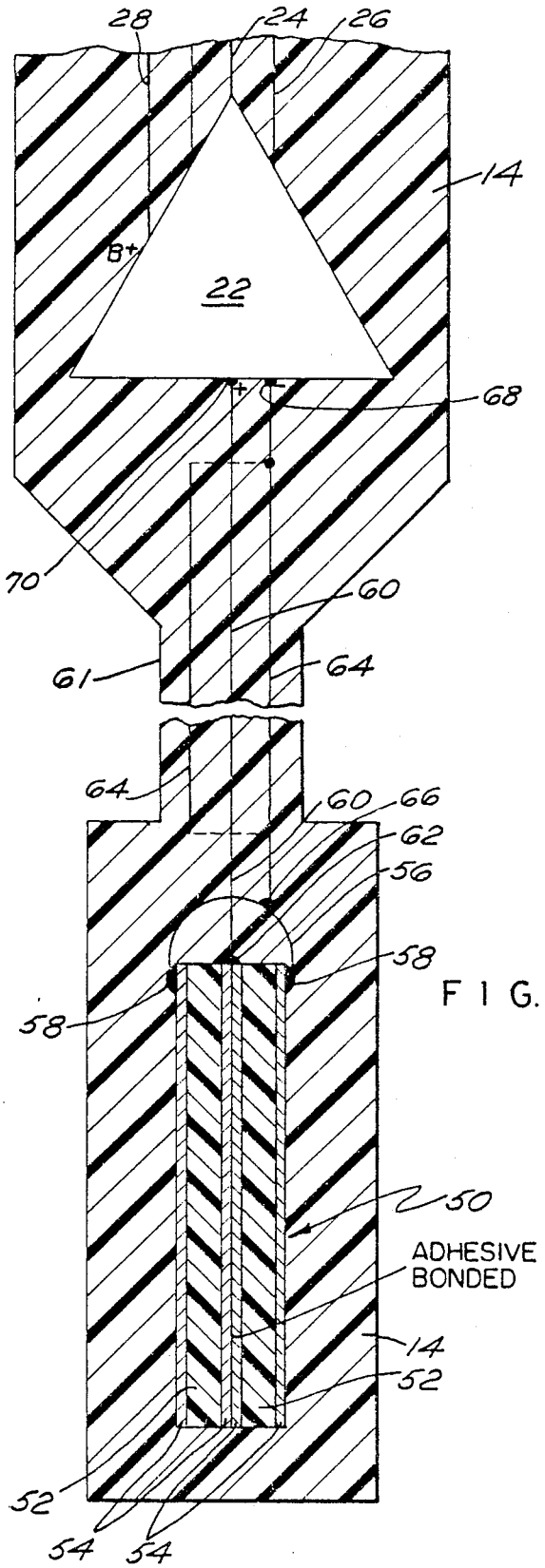
FIG. 3 shows an alternate embodiment of an acoustically transparent hydrophone according to present invention.

FIG. 3 shows an alternate hydrophone embodiment. A bilaminar sensing element assembly 50 is provided having a pair of identical voided PVDF slabs 52, each slab 52 being sandwiched between a pair of parallel copper electrodes 54 which have been deposited thereon using any of the well known techniques in the art of electrode formation. These slabs are then adhesively bonded together by means of adjacent electrodes 54 to form element assembly 50. The outer electrodes 54 are electrically connected together by lead 56 which is soldered to the electrodes at joints 58. The two interior electrodes 54 are electrically connected to a central lead 60 of a coaxial cable 61 by solder joint 62. Lead 56 is electrically connected to shield 64 of cable 61 by solder joint 66. At the amplifier 22 end of the hydrophone, shield 64 of cable 61 attaches at the negative (ground) solder joint 68 and central conductor 60 attaches at solder joint 70. This bilaminar arrangement is self-shielding due to the outer pair of electrodes 54 being at ground potential.

It is noted that a bilaminar element assembly twice as thick as a single element assembly will have high-frequency rolloff occur an octave earlier. The low-frequency sensitivity however may be higher than that of the single element hydrophone because of the greater capacitance of the bilaminar element.

Figure 4:
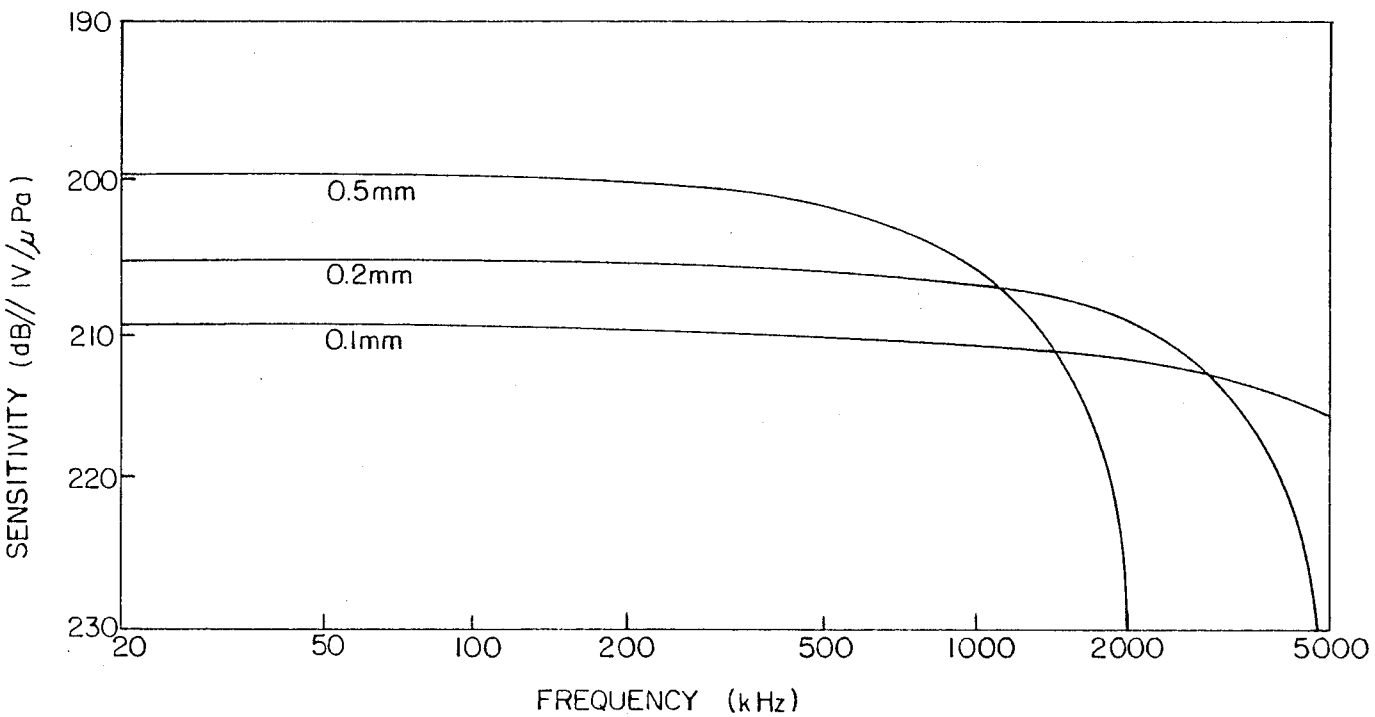
FIG. 4 shows a graphical representation of sensitivity vs. frequency for various voided PVDF hydrophone element thicknesses.

FIG. 4 shows the computed sensitivity for hydrophones having single element thicknesses of 0.1, 0.2 and 0.5 mm, respectively. As can be seen, the response rolls off at high frequencies toward a null response when the element becomes one elastic wavelength thick. Therefore, the element thickness should be much less than one elastic wavelength at the highest frequency of interest. For example, 0.2 mm provides nearly a flat response (0.5 dB rolloff) to 900 kHz. The transverse dimensions of the element determine the directional characteristics of the hydrophone (e.g., a 2-cm width yields a total 3 dB horizontal beamwidth of about 5.5° at 700 kHz). Preamplifier 22 should be as compact as possible, because it is a reflector of sound. A compromise must be made between locating preamplifier 22 a preselected distance far enough from PVD element 16 to minimize reflections from the preamplifier and yet near enough to the element to reduce the voltage coupling loss, $$L = 20 \log \frac{C_0}{C_0 + C_1}, \tag{3}$$

where $c_o$ is the capacitance of element 16 and $C_1$ is the sum of the capacitances of leads 20 and the preamplifier 22 input terminals. The capacitance $C_o$ depends on both frequency and temperature, because PVDF is a viscoelastic material. Therefore, it is desirable to make $C_1$ much less than the smallest $C_o$ to be encountered within the frequency and temperature range of interest.

An advantage of the present invention over the prior art is that because acoustic reflections both inside and outside voided PVDF element 16 are minimized, the hydrophone response can be made much flatter than can be done for conventional hydrophones. The elimination of internal reflections removes any resonance peaks in the response while the elimination of external reflections removes the frequency dependence due to diffraction. Because hydrophone 10 is essentially transparent to acoustic waves, an array of such hydrophones can be placed in the acoustic path of a transmitting array. Thus, the space in front of the projectors, which normally must be clear of obstructions, can be more effectively utilized.

What has thus been described is an acoustically transparent, voided, polyvinylidene fluoride (PVDF) hydrophone that matches the characteristic acoustic impedance of sea water, thereby drastically reducing diffraction and resonance effects. The frequency response is thus flat at frequencies less than one-half elastic wavelength.

Obviously many modifications and variations of the present invention may become apparent in light of the above teachings. For example, it may useful to add a plastic stiffening rod to hydrophone assembly 10 in order to facilitate correct orientation of the hydrophone during calibration measurements. This rod would attach to the upper end of PVDF element 16 and provide a stiff support for leads **20*a* and 20*b*. In practice, the lead attachment points 21 are on different corners of element 16**, and the electrodes are offset in the attachment regions so as to form acoustically inactive portions. Thus the acoustically active portion is well-defined, consisting only of the electroded area common to both element faces.

In light of the above, it is therefore understood that within the scope of the appended claims, the invention may be practiced otherwise than as specifically described.

What is claimed is:

1. A hydrophone assembly comprising:

voided piezoelectric polymer sensing element means, having a characteristic acoustic impedance ($\rho c$) selected to match that of sea water and a sensitivity based upon a preselected element means thickness, for producing electrical signals proportional to acoustic pressure waves impinging thereon:

a first electrical transmission means, the proximal end thereof being conductively attached to said sensing element means, for receiving and transmitting said electrical signals;

preamplifier means, attached to the distal end of said electrical transmission means, for receiving and amplifying said electrical signals from said electrical transmission means;

a second electrical transmission means, the proximal end thereof being conductively attached to said preamplifier means, for receiving said amplified signals from said preamplifier means and transmitting said amplifier signals to the distal end thereof; and and elastomer window material, having an acoustic impedance ($\rho c$) matching that of sea water and also matching said impedance of said sensing element means, said window material being potted under vacuum over said sensing element means, said first and second electrical transmission means, and said preamplifier means, for forming a waterproof covering for said hydrophone assembly which is at least acoustically transparent over said sensing element;

whereby said $\rho c$ voided sensing element means, in combination with said $\rho c$ elastomer window, form an acoustically transparent, non-resonant hydrophone assembly having a flat frequency response at frequencies $<1$ MHz.

2. A hydrophone assembly according to claim 1 wherein said sensing element means further comprises:

a slab of voided piezoelectric polymer having a preselected planar shape and thickness; and a pair of metal electrodes, one each deposited on one of the planar surfaces of said slab, said electrodes thereafter being parallel to each other and separated by the thickness of said slab, for conducting electric charge from the surfaces thereof.

3. A hydrophone assembly according to claim 2 wherein said first electrical transmission means further comprises a pair of wires, one each proximal end thereof being conductively attached to one of said metal electrodes.

4. A hydrophone assembly according to claim 3 wherein said second electrical transmission means further comprises a triaxial cable having a central conductor, an inner coaxial shield and an outer coaxial shield, said inner shield being attached to ground at the distal end thereof.

5. A hydrophone assembly according to claim 4 wherein said potted window material is a polyurethane.

6. A hydrophone assembly according to claim 5 wherein said voided piezoelectric polymer is a PVDF material.

7. A hydrophone assembly according to claim 6 wherein said first transmission means further comprises a shield about said pair of wires for providing electromagnetic interference (EMI) protection by suitable grounding thereof.

8. A hydrophone assembly according to claim 1 wherein said sensing element means further comprises:

a first slab of voided piezoelectric polymer having a preselected planar shape and thickness;

a first pair of metal electrodes, one each deposited on one of the planar surfaces of said first slab, said first electrodes thereafter being parallel to each other and separated by the thickness of said slab thus forming a first sensing layer, for conducting electric charge from the surfaces thereof;

a second slab of voided piezoelectric polymer having a preselected planar shape and thickness; and a second pair of metal electrodes, one each deposited on one of the planar surfaces of said second slab, said second electrodes thereafter being parallel to each other and separated by the thickness of said slab thus forming a second sensing layer, for conducting electric charge from the surfaces thereof;

said first and second sensing layers being adhesively bonded to one another along the interface between adjacent inner electrodes thereby forming a bilaminar sensing element.

9. A hydrophone assembly according to claim 8 wherein said first electrical transmission means further comprises a coaxial cable having a central conductor and an outer coaxial shield, said outer shield being conductively attached to each of said outer electrodes and said central conductor being conductively connected to said adjacent inner electrodes, said outer shield being grounded so as to provide EMI protection to said bilaminar sensing element while said central conductor transmits said signals to said preamplifier means.

10. A hydrophone assembly according to claim 9 wherein said second electrical transmission means further comprises a triaxial cable having a central conductor, an inner coaxial shield and an outer coaxial shield, said inner shield being attached to ground at the distal end thereof.

11. A hydrophone assembly according to claim 10 wherein said potted window material is a polyurethane.

12. A hydrophone assembly according to claim 11 wherein said voided piezoelectric polymer is a PVDF material.

* * * * *